US009052687B2

(12) United States Patent
Wu

(10) Patent No.: US 9,052,687 B2
(45) Date of Patent: Jun. 9, 2015

(54) IMAGE FORMING DEVICE, PROCESS CARTRIDGE ENGAGED WITH THE SAME AND METHOD FOR FIRMLY POSITIONING PROCESS CARTRIDGE IN IMAGE FORMING DEVICE

(75) Inventor: Lianjun Wu, Guangdong (CN)

(73) Assignee: Zhuhai Seine Technology Limited, Zhuhai, Guangdong (CN)

( * ) Notice: Subject to any disclaimer, the term of this patent is extended or adjusted under 35 U.S.C. 154(b) by 0 days.

(21) Appl. No.: 13/641,025

(22) PCT Filed: Jul. 19, 2011

(86) PCT No.: PCT/CN2011/077304

§ 371 (c)(1),
(2), (4) Date: Oct. 12, 2012

(87) PCT Pub. No.: WO2012/010076

PCT Pub. Date: Jan. 26, 2012

(65) Prior Publication Data

US 2013/0177333 A1 Jul. 11, 2013

(30) Foreign Application Priority Data

Jul. 22, 2010 (CN) ..... 2010 1 0234519

(51) Int. Cl.
*G03G 21/18* (2006.01)

(52) U.S. Cl.
CPC ..... *G03G 21/1842* (2013.01); *G03G 21/1853* (2013.01); *G03G 21/1864* (2013.01)

(58) Field of Classification Search
CPC ..... G03G 21/1842; G03G 21/1853; G03G 21/1864
USPC ..... 399/90, 111, 116, 119, 105
See application file for complete search history.

(56) References Cited

U.S. PATENT DOCUMENTS 5,066,976 A * 11/1991 Kanagawa et al. ..... 399/111
5,128,715 A * 7/1992 Furuyama et al. ..... 399/116

(Continued)

FOREIGN PATENT DOCUMENTS

CN 1707368 A * 12/2005
CN 101694567 A * 4/2010
JP 2000056656 A * 4/1998

OTHER PUBLICATIONS

Machine Translation JP 2000-056656, Terada Ichiro, Apr. 8, 1998.*

(Continued)

*Primary Examiner* — G. M. Hyder
(74) *Attorney, Agent, or Firm* — Jackson IPG PLLC; Demian K. Jackson

(57) ABSTRACT

An image forming device, a process cartridge engageable with the same and a method for firmly positioning the process cartridge in the image forming device. The image forming device includes a main frame and a main frame driving gear, wherein a guide rail is respectively arranged on left and right sides of the inside of the main frame. An installation section is arranged at a tail end of each guide rail and the installation section and guide rail respectively define a reverse hook-shape. Lugs formed at both ends of a housing of the process cartridge are driven by a radial component of driving force of the image forming device to the process cartridge to closely bear against walls of installation sections at the tail ends of the guide rails when the process cartridge is in an operating state in the image forming device.

13 Claims, 5 Drawing Sheets

(56) References Cited

U.S. PATENT DOCUMENTS

| | | | | |
|---|---|---|---|---|
| 5,369,474 | A * | 11/1994 | Yamada | 399/119 |
| 5,500,714 | A * | 3/1996 | Yashiro et al. | 399/111 |
| 6,366,749 | B1 * | 4/2002 | Koumoto | 399/113 |
| 6,876,826 | B2 * | 4/2005 | Noda et al. | 399/90 |
| 7,242,889 | B2 * | 7/2007 | Ahn et al. | 399/111 |
| 7,266,327 | B2 * | 9/2007 | Mori et al. | 399/111 |
| 7,395,008 | B2 * | 7/2008 | Sato et al. | 399/116 |
| 2004/0009008 | A1 * | 1/2004 | Park et al. | 399/116 |
| 2004/0165910 | A1 * | 8/2004 | Sato et al. | 399/116 |
| 2005/0276629 | A1 * | 12/2005 | Ahn et al. | 399/111 |
| 2006/0140674 | A1 * | 6/2006 | Sato | 399/119 |
| 2006/0285880 | A1 * | 12/2006 | Okabe | 399/111 |
| 2010/0054798 | A1 * | 3/2010 | Sato | 399/111 |
| 2011/0211866 | A1 * | 9/2011 | Hashimoto | 399/119 |

OTHER PUBLICATIONS

Machine Translation CN 101694567A, Yangyun Zeng, Apr. 14, 2010.*

* cited by examiner

IMAGE FORMING DEVICE, PROCESS CARTRIDGE ENGAGED WITH THE SAME AND METHOD FOR FIRMLY POSITIONING PROCESS CARTRIDGE IN IMAGE FORMING DEVICE

This application is a national stage entry in the United States of PCT/CN11/77304 filed Jul. 19, 2011 and claims priority to Chinese application 201010234519.8 filed Jul. 22, 2010.

FIELD OF THE INVENTION

The invention relates to an image forming device, a process cartridge engaged with the same and a method for firmly positioning the process cartridge in the image forming device.

BACKGROUND OF THE INVENTION

The electrophotographic image forming device is a device for forming an image on a recording material by electrophotographic imaging processing, for example, an electrophotographic copier, an electrophotographic printer (a laser printer, an LED printer, etc.), a facsimile apparatus, a word processor and the like.

FIG. 1 is a schematic diagram illustrating the engagement of the traditional process cartridge and image forming device. The traditional image forming device comprises a main frame 1 for the image forming device and a process cartridge 10 slideably coupled to the main frame 1, wherein the process cartridge 10 comprises components (not shown in the figure) among a developer, a developing roller, a supply roller, a doctor blade, a photosensitive drum and the like, and a photosensitive drum driving gear 15 engaged with a main frame driving gear 5 for transmitting driving force; first lugs 11 coaxially arranged with the photosensitive drum and second lugs 12 positioned at the downstream side of the first lugs 11, relative to the installation direction of the process cartridge, are formed on the surfaces of the opposite end parts of both sides of the process cartridge; the first lugs 11 and the second lugs 12 on the end parts of both sides of the process cartridge 10 are slideably coupled to the main frame 1 along curved guide rails 2 on two sidewalls of the main frame 1; the guide rails 2 guide the process cartridge 10 to enter into first lug installation positions 2*a* and second lug installation positions 2*b*; the shape of the guide rails 2 is as shown in FIG. 2; and tail ends 2*c* of the guide rails 2 are horizontal. When the first lugs of the process cartridge 10 are positioned at the installation positions 2*a* at the tail ends 2*c* of the guide rails 2, the first lugs 11 of the process cartridge 10, at the axial direction of the photosensitive drum, is under the action of the elastic pressure of stop components (such as springs, not shown in the figure), so that the process cartridge 10 is accurately positioned. Meanwhile, the photosensitive drum driving gear 15 of the process cartridge 10 is engaged with the main frame driving gear 5 on the main frame 1 for the image forming device, when the process cartridge 10 is assembled into the main frame.

The force condition of the process cartridge 10 when the image forming device is in the operating state is as shown in FIG. 2. When the process cartridge 10 is in the operating state, the photosensitive drum driving gear 15 of the process cartridge is engaged with the main frame driving gear 5; gear driving force F is transmitted from the main frame driving gear 5 to the process cartridge 10; the photosensitive drum driving gear 15 of the process cartridge is under the action of tangential force $F_t$ along the tangential direction of the photosensitive drum driving gear 15 and radial force $F_n$ along the direction of a line that links centers of the photosensitive drum driving gear 15 and the main frame driving gear 5, which are resolved by the gear driving force F; the tangential force $F_t$ drives the photosensitive drum gear 15 to rotate; and the radial force $F_n$ pushes the process cartridge 10 off an installation position. Therefore, elastic forcible pushing components (such as springs, not shown in the figure) are usually required to be arranged at the installation positions 2*a* of the first lugs 11, coaxially arranged with the photosensitive drum of the process cartridge, so that the process cartridge 10 is prevented from being disengaged. As the elastic forcible pushing components are required to be able to prevent the process cartridge 10 from being disengaged from the guide rails 2 and prevent the process cartridge 10 from rotating, the component, namely the radial force $F_n$, of the gear driving force F can be resolved into a horizontal component $F_{nx}$ and a vertical component $F_{ny}$ in the horizontal direction and the vertical direction respectively, as shown in FIG. 2. By adoption of the shape design, the guide rails of the traditional image forming device can only restrain the vertical component $F_{ny}$ of the radial force $F_n$ and cannot restrain the horizontal component $F_{nx}$ of the radial force $F_n$, so the elastic forcible pushing components (such as the springs) are required for preventing the process cartridge from being disengaged from the guide rails. However, the position bears large thrust force; the performance requirement of the springs is relatively high; and the positioning accuracy of the process cartridge in the image forming device is affected. Moreover, although the engagement mode of the traditional image forming device and process cartridge is simple, the process cartridge 10 can be driven to be disengaged from the installation position when the photosensitive drum driving gear 15 of the process cartridge 10 is under the action of the driving force of the main frame driving gear 5 of the image forming device, and consequently the image quality is poor.

SUMMARY OF THE INVENTION

The invention provides an image forming device, a process cartridge engaged with the same and a method for firmly positioning the process cartridge in the image forming device, to solve the technical problem that the image quality is affected by the low positioning accuracy of the process cartridge in the traditional image forming device.

The image forming device, comprising a main frame and a main frame driving gear, wherein a guide rail is respectively arranged on the left and right sides of the inside of said main frame; an installation section is arranged at the tail end of each guide rail; and said installation section and said guide rail approximately form a barb.

A second guide rail is also respectively arranged on the left and right sides of the inside of said main frame.

Said installation sections are provided with vertexes B which are higher than intersection points C of said installation sections and guide rails.

End points O of path centerlines of said installation sections are higher than starting points A thereof.

Lower parts DB of said installation sections are circular-arc.

Said installation sections are also provided with elastic forcible pushing components.

A process cartridge engaged with the image forming device, comprising a housing and a photosensitive drum, wherein lugs engaged with the installation sections at the tail ends of said guide rails are formed on said housing; said lugs and said photosensitive drum coaxially arranged; said photosensitive drum comprising a photosensitive drum gear; intersection points of an extension of a line that links centers of said photosensitive drum gear and said main frame driving gear and CB segments of said installation sections being higher than or level with the intersection points C of said installation sections and said guide rails.

Wherein second lugs engaged with said second guide rails are formed on said housing.

Wherein the diameter of said lugs is less than the distance from the starting points A to the end points O of the path centerlines of said installation sections.

A method for firmly positioning a process cartridge in an image forming device, comprising the following steps of: firstly, arranging installation sections which approximately form barbs with guide rails at the tail ends of said guide rails, which are arranged on the left and right sides of the inside of a main frame of said image forming device; and secondly, pushing said process cartridge, in which lugs engaged with said guide rails are formed at both ends of a housing, into said main frame, so that said lugs are engaged with said installation sections and a photosensitive drum gear of said process cartridge is engaged with a main frame driving gear in the radial direction for receiving driving force from said main frame driving gear.

Wherein said installation sections are provided with vertexes B which are higher than intersection points C of said installation sections and said guide rails.

Wherein the first step also comprises the following steps of respectively arranging a second guide rail on the left and right sides of the inside of said main frame and respectively forming a second lug engaged with said second guide rail at both ends of said housing; and the second step also comprises the following step of making said second lugs to be engaged with said second guide rails.

Wherein the first step also comprises the following step of arranging elastic forcible pushing components on said installation sections for forcibly pushing said lugs.

By adoption of the technical proposal, as installation sections are arranged at the tail ends of guide rails and the installation sections and the guide rails approximately form barbs, lugs formed at both ends of a housing of the process cartridge are driven by a radial component of driving force of the image forming device to the process cartridge to always closely lean against the walls of the installation sections at the tail ends of the guide rails when the process cartridge is in the operating state in the image forming device. Therefore, not only the installation is convenient but also the positioning is reliable; the vibration of the photosensitive drum during the image forming is reduced; and the technical problem that the image quality is affected by the low positioning accuracy of the process cartridge in the traditional image forming device is solved.

DETAILED DESCRIPTION OF THE PREFERRED EMBODIMENTS

Figure 1:
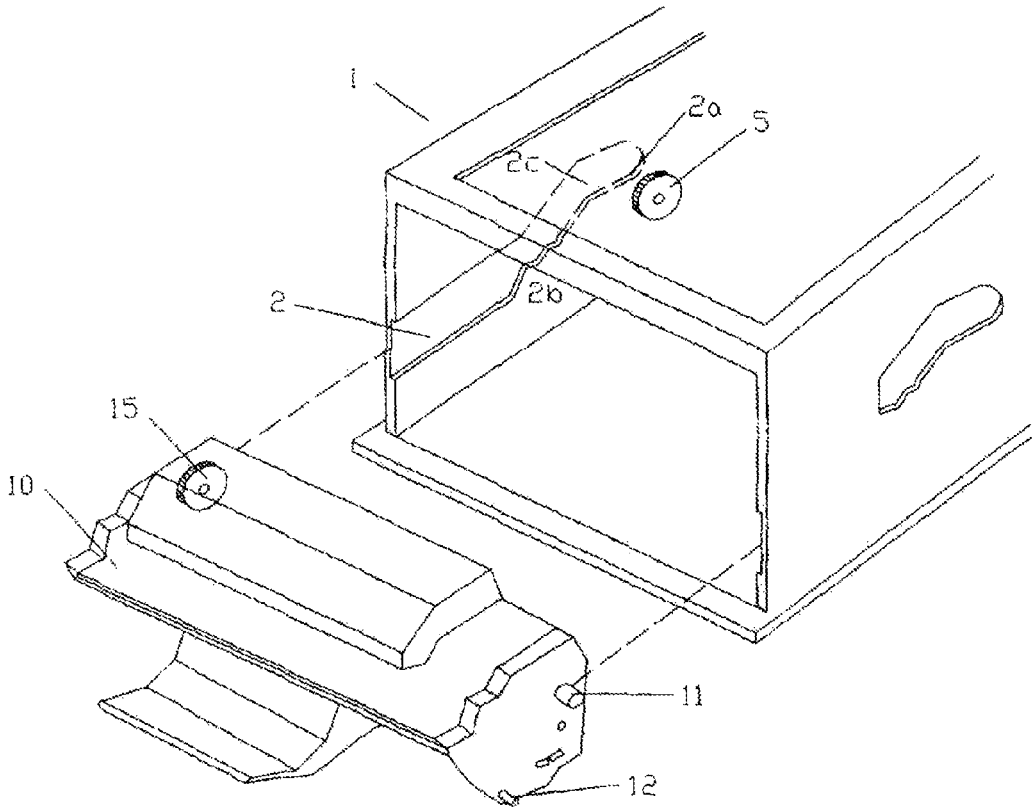
Fig. 1 (Prior Art)
FIG. 1 is a schematic diagram illustrating the engagement of the traditional process cartridge and image forming device.
Figure 2:
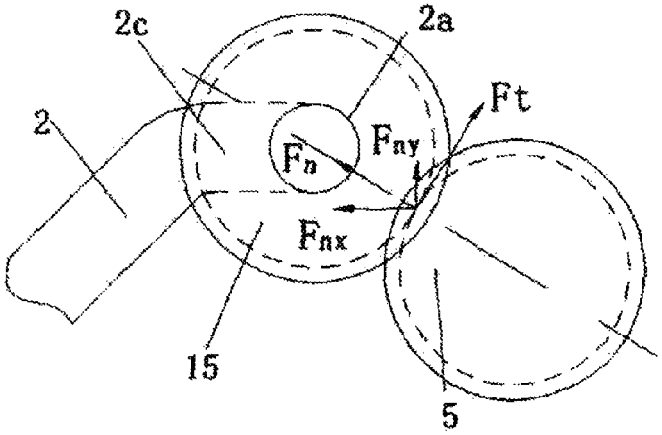
Fig. 2 (Prior Art)
FIG. 2 is a schematic diagram illustrating the force condition of the traditional process cartridge when the image forming device is in the operating state.
Figure 3:
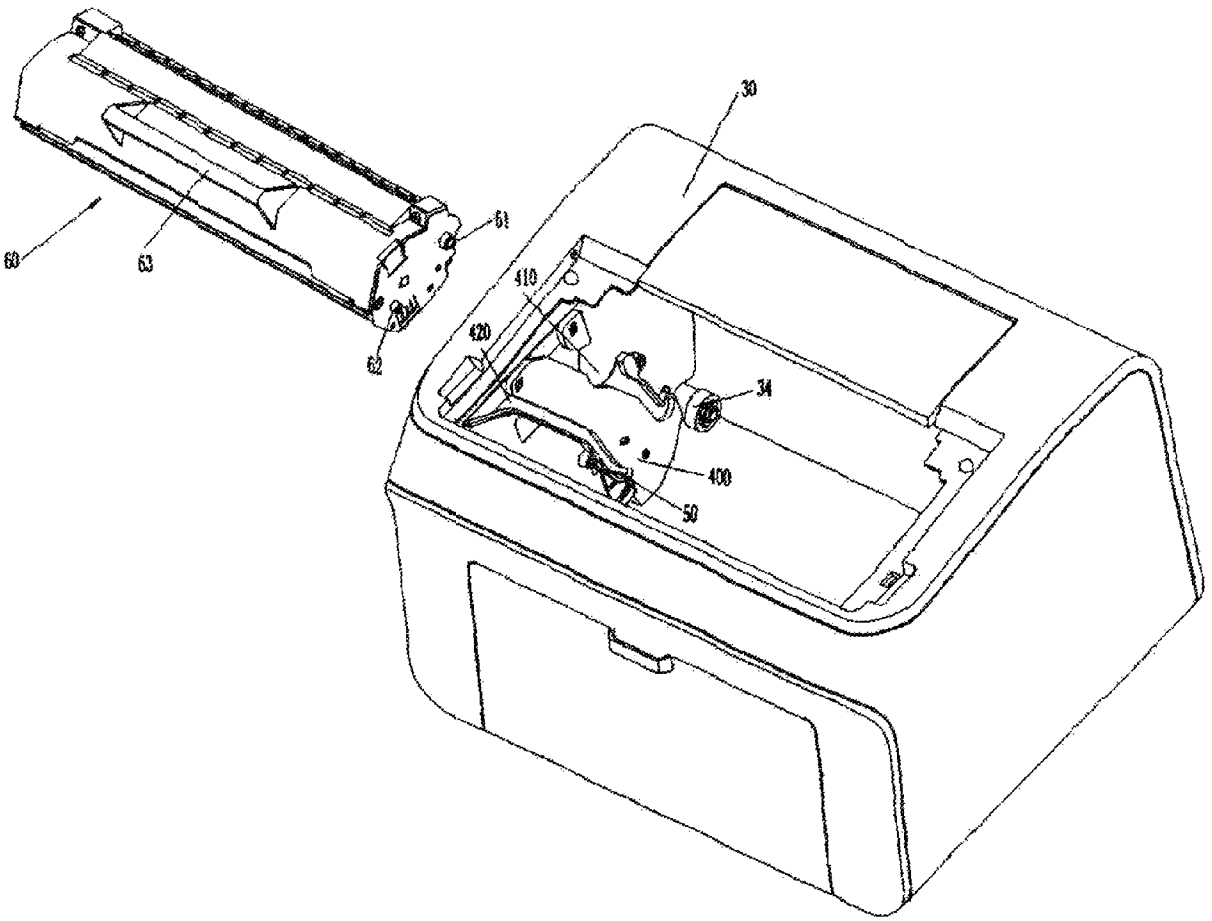
FIG. 3 is a schematic diagram illustrating the engagement of a process cartridge and an image forming device, provided by the invention.
Figure 4:
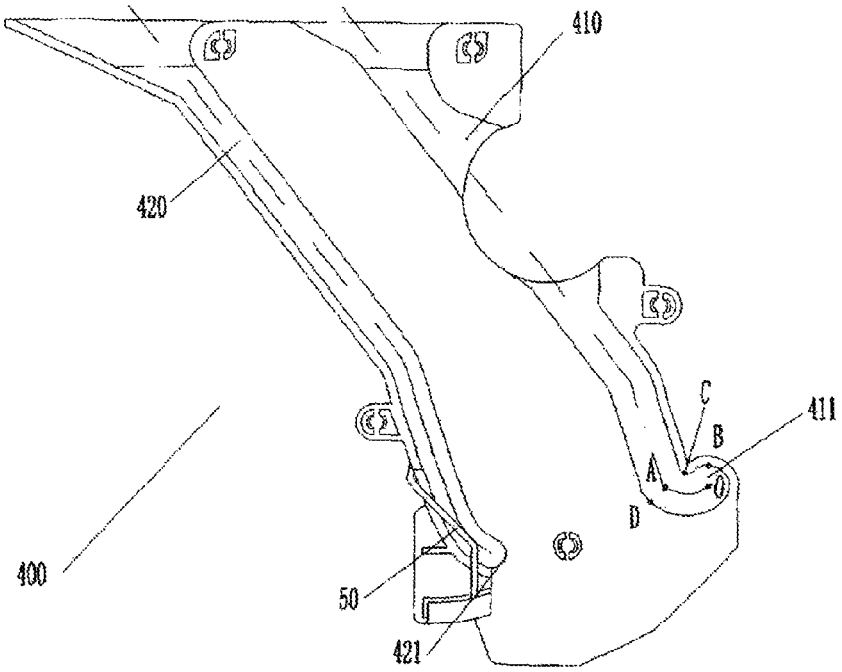
FIG. 4 is a structure diagram of a guide rail in the invention.

As illustrated in FIGS. 3 and 4, the image forming device comprises a main frame 30 and guide rails 400 which are arranged on the left and right sides of the inside of the main frame 30, wherein first guide rails 410 and second guide rails 420 are arranged on the guide rails 400; the guide rails approximately adopt top-down design; circular-arc installation sections 411 are arranged at the tail ends of the first guide rails 410; the installation sections 411 and the first guide rails 410 approximately form barbs; vertexes B of the installation sections 411 are higher than intersection points C of the installation sections 411 and the first guide rails 410, so the barbs are formed; and end points O of path centerlines AO of the installation sections 411 are higher than starting points A thereof.

Lower parts DB of the installation sections 411 are circular arcs of which the curvature is different from that of the guide rails. Due to the arrangement of the circular arcs, the process cartridge is smoother and more convenient to be assembled and disassembled.

The installation sections 411 of the first guide rails 410 can also be provided with elastic forcible pushing components. The elastic forcible pushing components in the embodiment are torsion springs and of course can be other elastic forcible pushing components with the same function.

Installation sections 421 are arranged at the tail ends of the second guide rails 420 and also provided with elastic forcible pushing components. The elastic forcible pushing components in the embodiment are torsion springs 50 and of course can be other elastic forcible pushing components with the same function.

Figure 5:
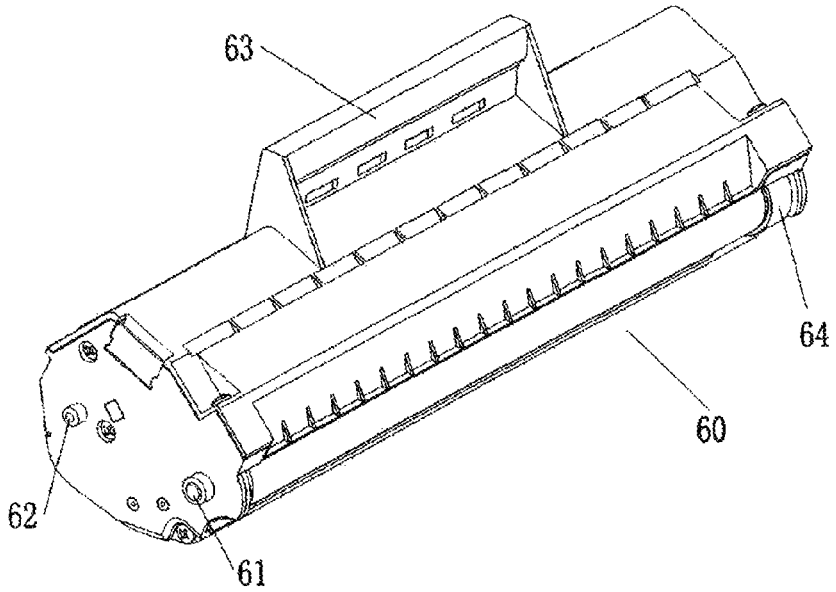
FIG. 5 is a perspective view of the process cartridge provided by the invention.
Figure 6:
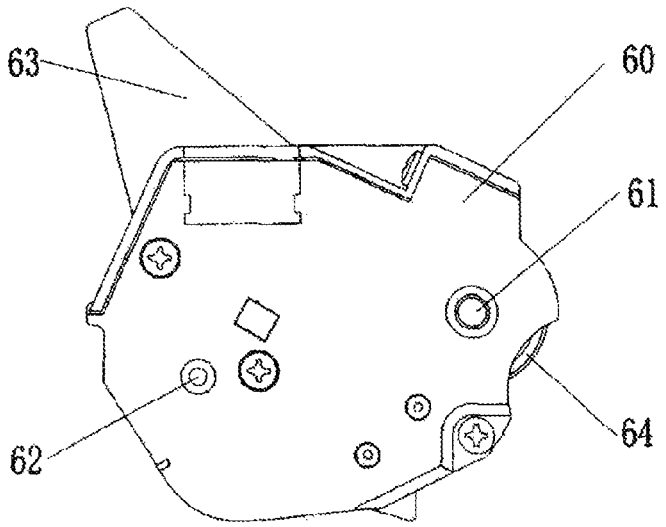
FIG. 6 is a structure diagram of the end part of the process cartridge provided by the invention.

A process cartridge 60 comprises a photosensitive drum, a charging roller, a developing roller, an end cover, a toner hopper and a waste bin (not shown in the figure), as shown in FIGS. 5 and 6. First lugs 61 and second lugs 62, which are engaged with the first guide rails 410 and the second guide rails 420 respectively, are formed on two end parts of the process cartridge 60. The first lugs 61 and the photosensitive drum are coaxially arranged, and the second lugs 62 are positioned at the downstream side of the first lugs 61, relative to the installation direction of the process cartridge.

Figure 7:
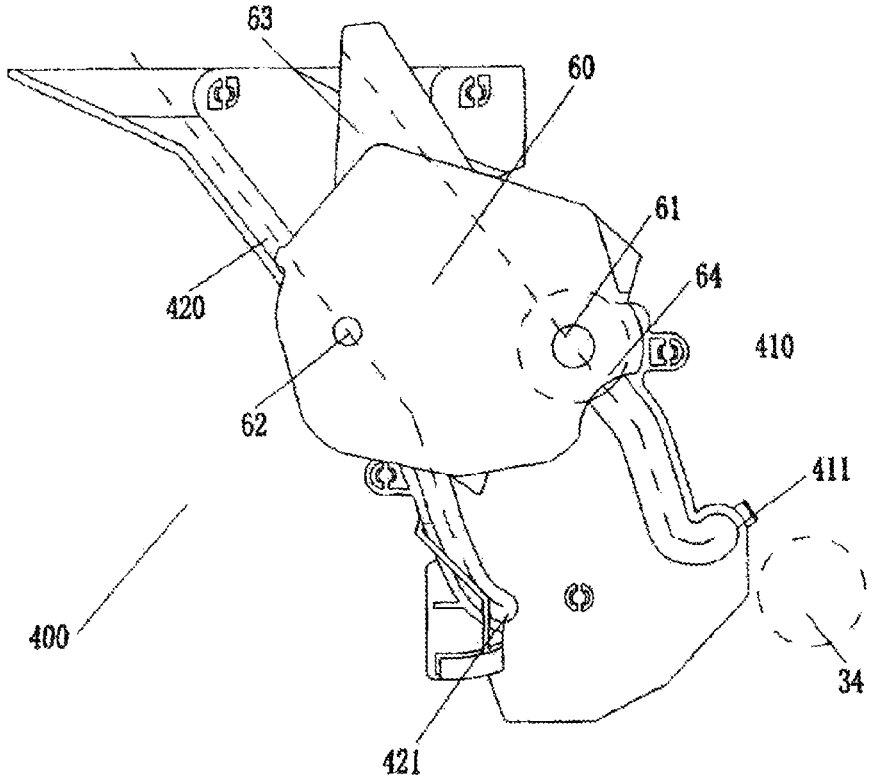
FIG. 7 is a schematic diagram illustrating the state when the process cartridge provided by the invention is in the first installation phase.
Figure 8:
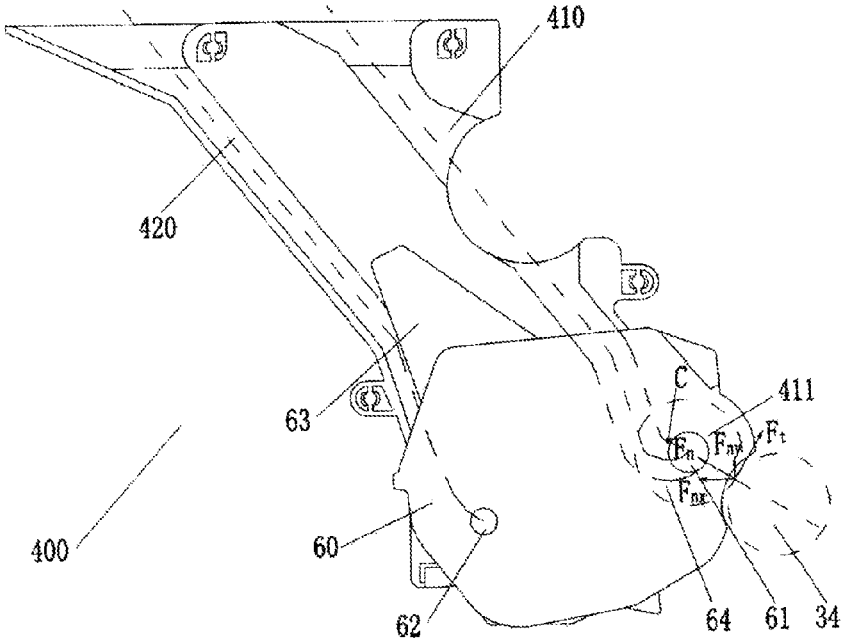
FIG. 8 is a schematic diagram illustrating the state when the process cartridge provided by the invention is in the second installation phase.

The process of assembling the process cartridge 60 into the main frame 30 in the embodiment is as illustrated in FIGS. 7 and 8. The process cartridge 60 is assembled into the main frame 30 in the direction perpendicular to the axial direction of the photosensitive drum. When the process cartridge 60 is inserted into the image forming device, the first lugs 61 and the second lugs 62 formed on the two end parts of the process cartridge 60 are combined with the first guide rails 410 and the second guide rails 420 of the guide rails 400 respectively. Under the action of definite installation pressure, the first lugs 61 of the process cartridge arrive at the first installation sections 411 along the first guide rails 410, and the second lugs 62 of the process cartridge arrive at the second installation sections 421 along the second guide rails 420, at which the second lugs 62 are clamped by the torsion springs 50. The torsion springs 50 push the second lugs 62 of the process cartridge 60 with definite elastic force, so as to limit the rotation of the process cartridge 60, thus stable positioning of the process cartridge 60 in the main frame 30 is realized.

When the process cartridge 60 is arranged at the installation sections 411 in the image forming device, intersection points of an extension of a line that links centers of a photosensitive drum gear 64 and a main frame driving gear 34 and CB segments of the installation sections are higher than or level with the intersection points of the installation sections 411 and the guide rails 410.

Moreover, for the installation sections of the guide rails to be barbed and the process cartridge to be smoothly assembled into or disassembled from the image forming device, the diameter of the lugs 61 of the process cartridge 60 should be less than the distance of the path centerlines AO of the installation sections 411.

Figure 9:
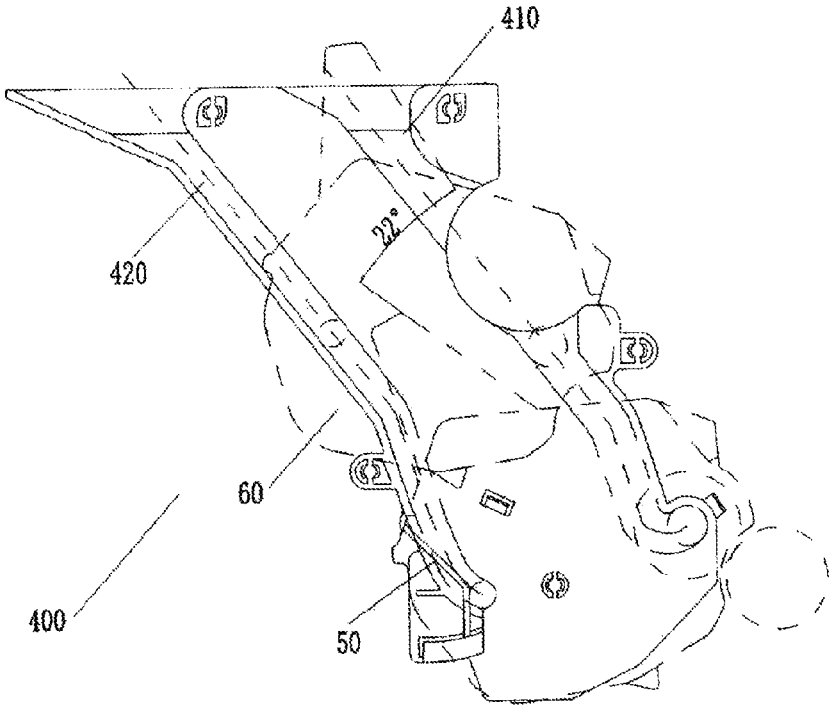
FIG. 9 is a schematic diagram illustrating the position deflection of the process cartridge provided by the invention at different phases.

After the first lugs 61 and the second lugs 62 of the process cartridge 60 arrive at the first installation sections 411 and the second installation sections 421 along the first guide rails and the second guide rails respectively, the forward speed of the first lugs 61 of the process cartridge is relatively slow while the forward speed of the second lugs 62 of the process cartridge is relatively fast; and the rotation angle of the first lugs 61 is more than that of the second lugs 62. The process cartridge 60 is rotated by a certain angle (in the embodiment, as illustrated in FIG. 9, the rotation angle of a handle 63 of the process cartridge 60 is about 22 DEG from the time when the process cartridge 60 is assembled into the main frame 30 to the time when the photosensitive drum gear 64 of the process cartridge 60 is engaged with the main frame driving gear 34), so that the photosensitive drum gear 64 of the process cartridge is engaged with the main frame driving gear 34 of the image forming device. The rotation effectively utilizes the inner space of the image forming device, so materials are saved and the miniaturization of the image forming device is realized. When the process cartridge 60 is disassembled, the handle 63 of the process cartridge 60 is directly held, and the process cartridge 60 can be disassembled just after the first lugs 61 and the second lugs 62 of the process cartridge 60 move outward along the guide rails 400. The mode of assembly and disassembly of the process cartridge is very simple.

The image forming device is in the operating state when the photosensitive drum gear 64 of the process cartridge is positioned at a position at which the photosensitive drum gear 64 is engaged with the main frame driving gear 34 and receives driving force transmitted by the main frame driving gear 34. The force condition of the process cartridge 60 when the image forming device is in the operating state is as illustrated in FIG. 8. When the image forming device is in the operating state, the photosensitive drum gear 64 is engaged with the main frame driving gear 34; the driving force F is transmitted from the main frame driving gear 34 to the photosensitive drum gear 64 of the process cartridge; the photosensitive drum gear 64 of the process cartridge is under the action of tangential force Ft along the tangential direction of the photosensitive drum gear 64 and radial force Fn along the direction of the line that links centers of the photosensitive drum gear 64 and the main frame driving gear 34, which are resolved by the driving force F; the tangential force Ft drives the photosensitive drum gear 64 to rotate; and the radial force Fn pushes the process cartridge 60 off the installation position and can be resolved into a horizontal component Fnx and a vertical component Fny in the horizontal direction and the vertical direction respectively.

In the embodiment, the installation sections 411 are arranged at the tail ends of the first guide rails; the vertexes B of the installation sections 411 are higher than the intersection points C of the installation sections and the guide rails; and both the installation sections and the guide rails form the barbs. When the process cartridge 60 is positioned at the installation sections 411 in the image forming device, the intersection points of the extension of the line that links centers of the photosensitive drum gear 64 and the main frame driving gear 34 and the CB segments of the installation sections are higher than or level with the intersection points C of the installation sections 411 and the guide rails. When the process cartridge 60 is under the action of the radial force Fn along the centerline of the photosensitive drum gear 64 and the main frame driving gear 34, the horizontal component Fnx and the vertical component Fny of the radial force Fn can be effectively restrained by adoption of the structure, so that the first lugs, coaxially arranged with the photosensitive drum, of the process cartridge are pushed against the walls of the installation sections, thus the vibration of the photosensitive drum in the operating process is extremely effectively reduced, consequently the image quality is guaranteed and the stop force required of the elastic forcible pushing components is further reduced a great extent. Therefore, in the embodiment, the elastic forcible pushing components of the image forming device are the torsion springs 50 arranged at the second installation positions 421 of the second guide rails 420. The torsion springs 50 are used for preventing the process cartridge 60 from rotating, and small force can be applied for the accurate positioning of the process cartridge 60. Compared with the technical proposal in the prior art that the first lugs 11 coaxially arranged with the photosensitive drum are pushed by the torsion springs to determine the position of the process cartridge 10, the invention can reduce the requirements on the stop elastic force of the elastic forcible pushing components and the performances of stop components and consequently reduce the cost, improve the positioning accuracy and guarantee the image quality finally.

According to one aspect of the patent, when the first lugs 61, coaxially arranged with the photosensitive drum, on the two end parts of the process cartridge 60, arrive at the walls of the installation sections 411 of the first guide rails 410, the intersection points of the extension of the line that links centers of the photosensitive drum gear 64 and the main frame driving gear 34 and the CB segments of the installation sections are higher than or level with the intersection points C of the installation sections 411 and the guide rails 410, so that the radial force $F_n$ of the gear driving force F can be effectively restrained. As illustrated in FIG. 8, in the embodiment, the intersection points of the extension of the line that links centers of the photosensitive drum gear and the main frame driving gear and the CB segments of the installation sections are level with the intersection points C of the installation sections 411 and the guide rails 410.

According to one aspect of the patent, the elastic forcible pushing components can be arranged at the first installation positions of the first guide rails or the second installation positions of the second guide rails or can be simultaneously arranged at the two installation positions. No matter how the installation mode is changed, the invention can effectively reduce the elastic stop force, at the installation position of the process cartridge, required for preventing the process cartridge from being disengaged from the guide rails, and thus improve the positioning accuracy of the process cartridge and consequently improve the image quality.

As described above, the process cartridge can be stably and conveniently assembled or disassembled, so the positioning accuracy of the process cartridge can be improved, thus the service performances of users and the image quality can be improved.

What is claimed is:

1. An image forming device, comprising:

a main frame and a main frame driving gear, a first set of guide rails respectively arranged on left and right sides of an inside of said main frame; and curved installation sections arranged at tail ends of each first guide rail; and wherein each said installation section and said first guide rail respectively define a reverse hook-shape wherein the curved installation sections each define respective vertexes (B) which, in an operating orientation of the image forming device, are higher than respective adjacent intersection points (C) between the installation sections and the first guide rails and wherein intersection points of an extension of a line that links centers of a photosensitive drum gear of a process cartridge and the main frame driving gear and segments (CB) of said installation sections are higher than or level with said intersection points (C).

2. The image forming device according to claim 1, further comprising a second set of guide rails respectively arranged on the left and right sides of the inside of said main frame.

3. The image forming device according to claim 2, wherein installation sections of the second guide rails are also each provided with elastic forcible pushing components.

4. The image forming device according to claim 1, wherein, in the installation orientation of the image forming device, distal end points (O) of path centerlines of said installation sections are higher than proximal starting points (A) thereof.

5. The process cartridge engageable with the image forming device of claim 1, comprising a housing and a photosensitive drum, wherein first lugs engageable with the respective installation sections at the tail ends of said first guide rails are formed on said housing; and said first lugs and said photosensitive drum are coaxially arranged.

6. The process cartridge according to claim 5, further comprising second lugs engageable with second guide rails formed on said housing.

7. The process cartridge according to claim 5, wherein a diameter of said first lugs is less than a distance from starting points (A) to end points (O) of path centerlines of said installation sections.

8. The process cartridge according to claim 7, wherein said photosensitive drum gear is engaged with said main frame driving gear in the radial direction and receives driving force from said main frame driving gear.

9. A method for firmly positioning a process cartridge in an image forming device, comprising the following steps of:

firstly, arranging curved installation sections which respectively define a reverse hook-shape with first guide rails at the tail ends of said first guide rails, which are arranged on left and right sides of the inside of a main frame of said image forming device wherein the curved installation sections each define respective vertexes (B) which, in an operating orientation of the image forming device, are higher than respective adjacent intersection points (C) between the installation sections and the first guide rails; and secondly, pushing said process cartridge, in which lugs engaged with said first guide rails are formed at both ends of a housing, into said main frame, so that said lugs are engaged with said installation sections and a photosensitive drum gear of said process cartridge is engaged with a main frame driving gear in the radial direction for receiving driving force from said main frame driving gear and such that intersection points of an extension of a line that links centers of the photosensitive drum gear and the main frame driving gear and segments (CB) of said installation sections are higher than or level with said intersection points (C).

10. The method for firmly positioning a process cartridge in an image forming device according to claim 9, wherein the driving force comprises a tangential force component along a tangential direction of said photosensitive drum gear and a radial force component along the direction of the line that links centers of said photosensitive drum gear and said main frame driving gear; the tangential force drives said photosensitive drum gear to rotate; and the radial force pushes said lugs coaxially arranged with said photosensitive drum against said installation sections.

11. The method for firmly positioning a process cartridge in an image forming device according to claim 10, wherein the first step also comprises the following steps of respectively arranging a second guide rail on the left and right sides of the inside of said main frame and respectively forming a second lug engaged with said second guide rail at both ends of said housing; and the second step also comprises the following step of making said second lugs to be engaged with said second guide rails.

12. The method for firmly positioning a process cartridge in an image forming device according to claim 11, wherein the first step also comprises the following step of arranging elastic forcible pushing components on installation sections of the second guide rails for forcibly pushing said lugs.

13. The method for firmly positioning said process cartridge in said image forming device according to claim 9, wherein a diameter of said first lugs is less than a distance from starting points (A) to end points (0) of path centerlines of said installation sections.

* * * * *